US011727900B2

(12) United States Patent
Heubeck

(10) Patent No.: US 11,727,900 B2
(45) Date of Patent: Aug. 15, 2023

(54) HANDPAN

(71) Applicant: Roland Meinl Musikinstrumente GmbH & Co. KG, Gutenstetten (DE)

(72) Inventor: Udo Heubeck, Diespeck (DE)

(73) Assignee: ROLAND MEINL MUSIKINSTRUMENTE GMBH & CO. KG, Gutenstetten (DE)

( * ) Notice: Subject to any disclaimer, the term of this patent is extended or adjusted under 35 U.S.C. 154(b) by 0 days.

(21) Appl. No.: 17/512,861

(22) Filed: Oct. 28, 2021

(65) Prior Publication Data

US 2022/0130356 A1 Apr. 28, 2022

(30) Foreign Application Priority Data

Oct. 28, 2020 (DE) ..... 20 2020 106 174.7

(51) Int. Cl.
*G10D 13/08* (2020.01)
*G10D 13/22* (2020.01)

(52) U.S. Cl.
CPC ..... *G10D 13/08* (2013.01); *G10D 13/22* (2020.02)

(58) Field of Classification Search
CPC ..... G10D 13/08; G10D 13/22; G10D 13/00
See application file for complete search history.

(56) References Cited

U.S. PATENT DOCUMENTS 10,373,594 B1 * 8/2019 Doe ..... G10D 13/02

FOREIGN PATENT DOCUMENTS

| | | | | |
|---|---|---|---|---|
| CN | 205609190 U | * | 9/2016 | ..... G10D 13/02 |
| DE | 202016005454 U1 | | 3/2017 | |
| DE | 202016005454 U1 | * | 4/2017 | ..... G10D 13/02 |
| GB | 2580887 A | | 8/2020 | |

OTHER PUBLICATIONS en.wikipedia.org/wiki/Handpan, Jul. 2021.

* cited by examiner

*Primary Examiner* — Kimberly R Lockett
(74) *Attorney, Agent, or Firm* — Browdy and Neimark, PLLC

(57) ABSTRACT

A handpan comprises a hollow base body, composed of a lower shell and an upper shell, each in the form of a spherical segment, which are connected to one another, preferably glued, at their mutually facing outer edges, a basic tone field preferably arranged centrally on the upper shell, further tone fields arranged annularly on the upper shell, preferably around the basic tone field, a resonance opening in the lower shell, and at least one further resonance opening in the lower shell, wherein the at least two resonance openings are arranged decentrally in the lateral rising zone of the lower shell.

15 Claims, 5 Drawing Sheets

HANDPAN

CROSS-REFERENCES TO RELATED APPLICATIONS

This application claims the priority of German Utility Model Application, Serial No. 20 2020 106 174.7, filed Oct. 28, 2020, the content of which is incorporated herein by reference in its entirety as if fully set forth herein.

FIELD OF THE INVENTION

The invention relates to a musical instrument in the form of a handpan having the features indicated in the generic term of claim 1.

BACKGROUND OF THE INVENTION

Handpans have been known as musical instruments since about 2008 and have been derived from a similar brass sound instrument called a Hang®. A good overview and a description of the known features of a handpan can be found in the Wikipedia article of the same name, downloadable from the internet via the website "https://de.wikipedia.org/wiki/Handpan".

Accordingly, a handpan comprises a hollow base body composed of a lower shell and an upper shell each in the shape of a spherical segment, which are connected to each other, preferably glued, at their ring surfaces facing each other. Furthermore, a central base tone field is provided on the upper shell, which is usually tuned to the lowest tone of the handpan. Around the central base tone field, further tone fields are arranged annularly on the upper shell, which are usually tuned to different tones.

In the lower shell of the known handpans, analogous to the so-called Gu of a Hang®, a central resonance opening is formed, which contributes to the soundscape of the instrument in a variety of ways not to be discussed in detail here.

The resonance opening at the bottom is also used in the manufacture of the handpan to allow fine tuning of the tone fields on the upper shell from the inside with a special tuning hammer after the upper and lower shells have been joined.

The problem with the known handpans is the central arrangement of the resonance opening. This means that when the instrument is played while placed on a flat surface, the resonance opening is closed off and therefore no longer contributes to the soundscape of the instrument, or only insufficiently does so. In addition, the sound radiation through the resonance opening, on the one hand, is directed downwards towards the floor when the instrument is played conventionally, resting on the thighs, and on the other hand is considerably damped by the thighs under certain circumstances, and is therefore in need of improvement.

SUMMARY OF THE INVENTION

Based on the described problems of the prior art, it is an object of the invention to further develop a handpan of the generic type in such a way that it has an improved soundscape and can be processed more easily for fine tuning under various conditions of use.

This object is achieved in that at least one further resonance opening is provided on the lower shell, wherein corresponding at least two resonance openings are arranged decentrally in the lateral, rising zones of the lower shell.

Due to this decentralized arrangement of at least two resonance openings, they remain open and thus effective even when the handpan is played while placed on a flat surface. Even if the instrument is handled in the usual manner on the thighs, the resonance openings may be arranged such that one of them points obliquely forward, whereby the sound radiation direction of the instrument is aimed at possible listeners and is thus significantly more effective.

The lateral, decentrally arranged resonance openings are also more accessible to the player than the resonance hole arranged centrally at the bottom, so that it is easier to manually dampen the so-called sustain of the handpan by closing or at least partially covering the resonance openings—similar to a resonance hole cover used on acoustic guitars.

The design according to the invention also has advantages when playing the handpan on a stand provided for this purpose. With a conventional central resonance hole, the sound bounces against the struts of the stand and thus generates disturbing vibrations. The lateral resonance openings, however, ensure free, unobstructed sound development, which also has a positive effect on miking and sound pickup. One or more microphones may be used to obtain a broader soundscape.

Last but not least, the fine tuning of the handpan is considerably simplified when the upper and lower shells are joined together, since the tone fields distributed over the upper shell at the top are basically accessible from below via two openings. In addition, both hands of the instrument maker can be used for fine tuning, or the tuning hammer can be inserted via one resonance opening and the work can be visually checked via the other resonance opening. This considerably simplifies and perfects the tuning work.

Preferred further embodiments of the subject matter of the invention are indicated further on. Thus, two, three or four resonance openings may be provided, which are then preferably arranged in a row therein evenly distributed with respect to the circumferential direction of the lower shell. Thus, the handpan also has a visually appealing, tidy appearance.

The same purpose is served by the possible design of the resonance openings with the same diameter, although different diameters are also conceivable to produce certain sound effects.

Further preferred embodiments relate to the surface dimension of the central zone not occupied by the resonance openings and the distances of the resonance openings from the outer edge of the lower shell. A balanced sonic and visual image of the handpan results when this corresponding surface dimension of the central zone and/or this distance substantially correspond to the diameter of the resonance openings.

Further features, details and advantages of the invention will be apparent from the following description of various embodiments.

DESCRIPTION OF THE PREFERRED EMBODIMENTS

Figure 1:
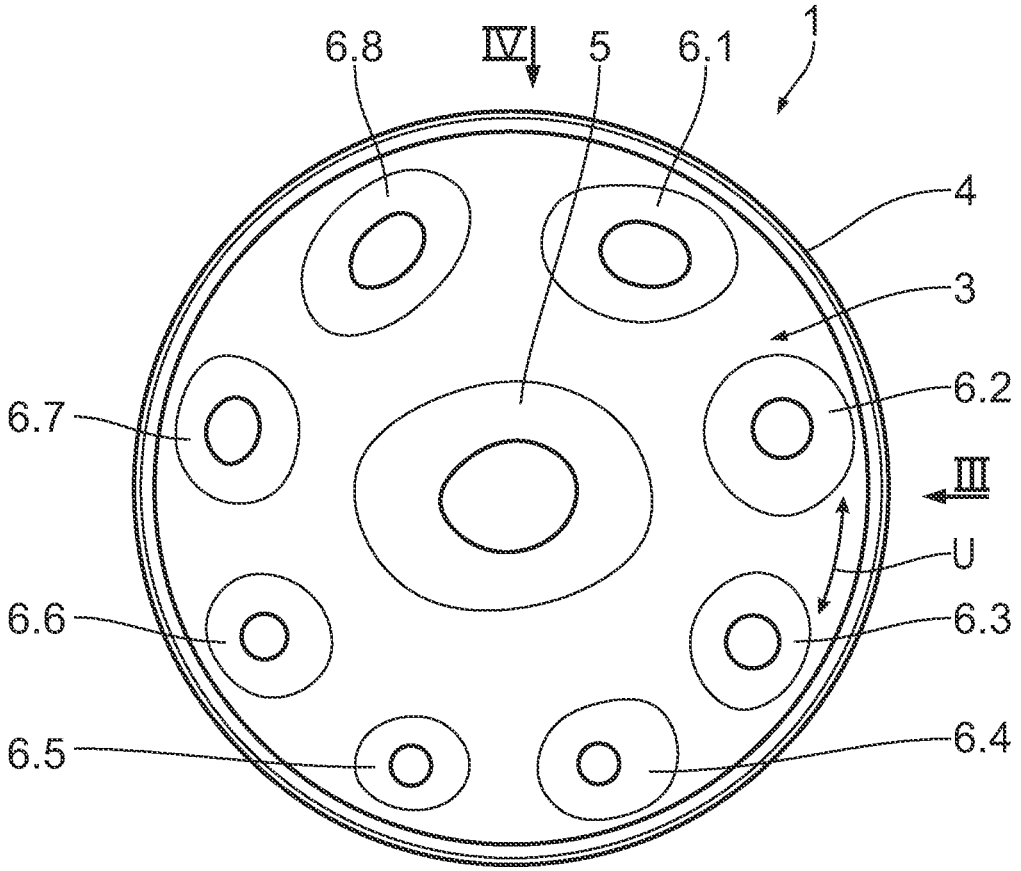
FIG. 1 to 4 show a top view, a perspective view obliquely from above and two side views from the arrow directions III and IV, respectively, according to FIG. 1 of a handpan in a first embodiment.

As can be seen from FIG. 1 to 4, the handpan shown there has a hollow base body 1 which is composed of a respective hemispherical segment-shaped flat lower shell 2 and an upper shell 3 of corresponding basic shape. The two shells 2, 3 are glued together over their entire circumference at their facing outer edges 4.

Figure 2:
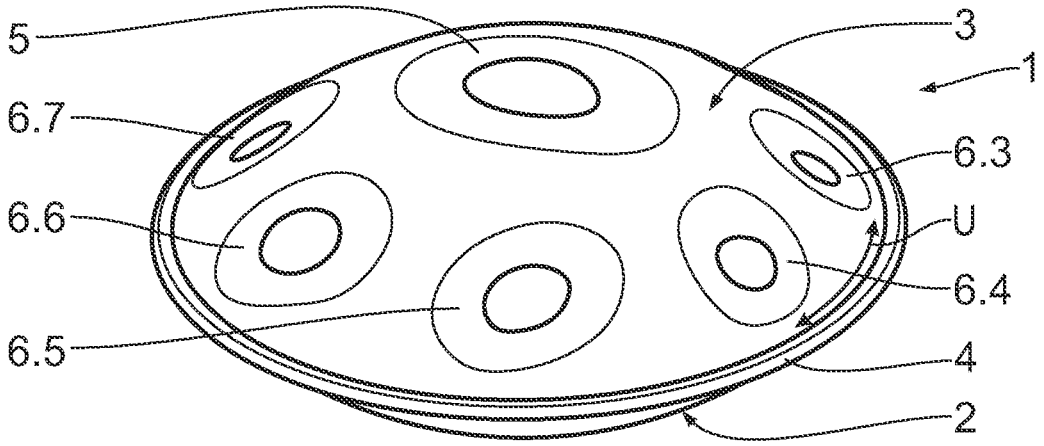
Figure 3:
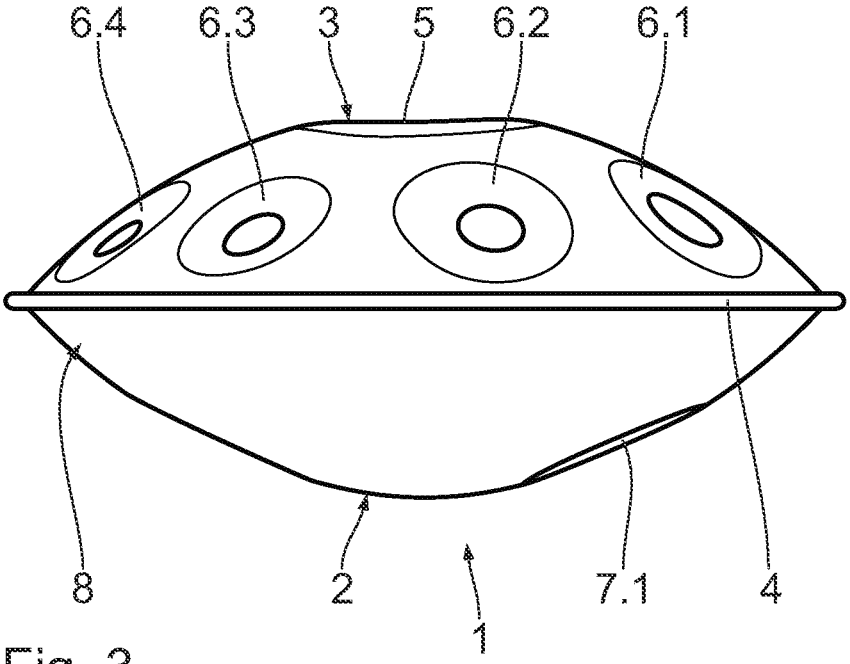
Figure 4:
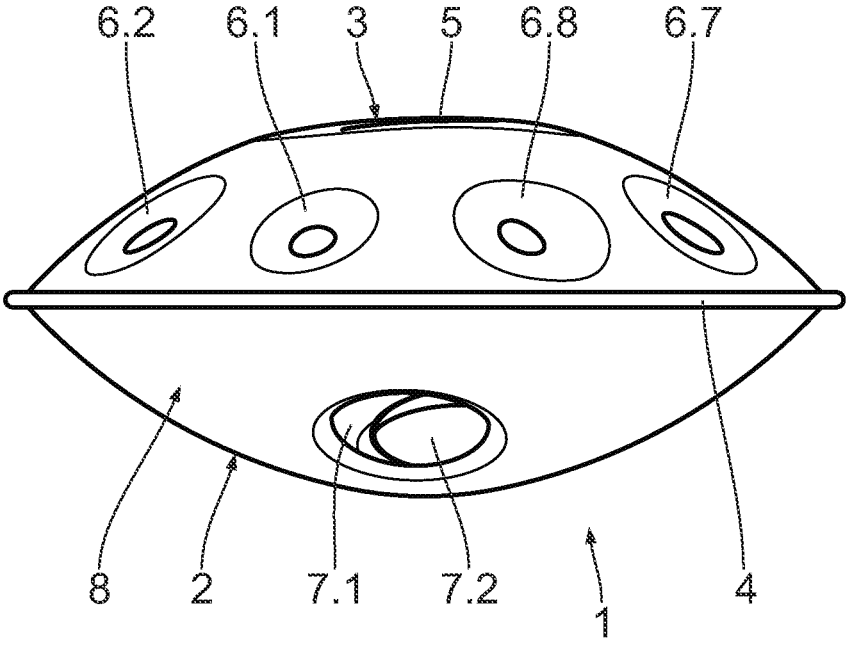
Figure 5:
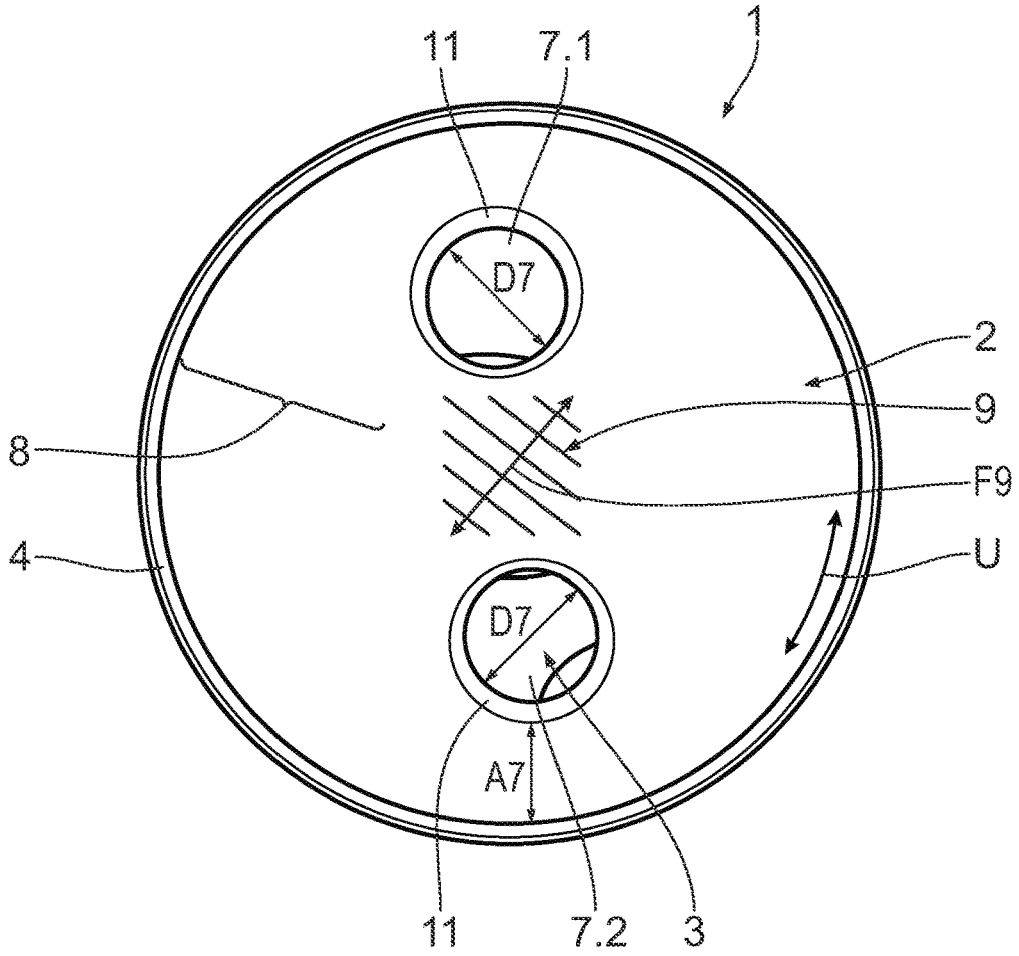
FIGS. 5 and 6 show a bottom view and perspective view, obliquely from below, of the handpan in this first embodiment.
Figure 6:
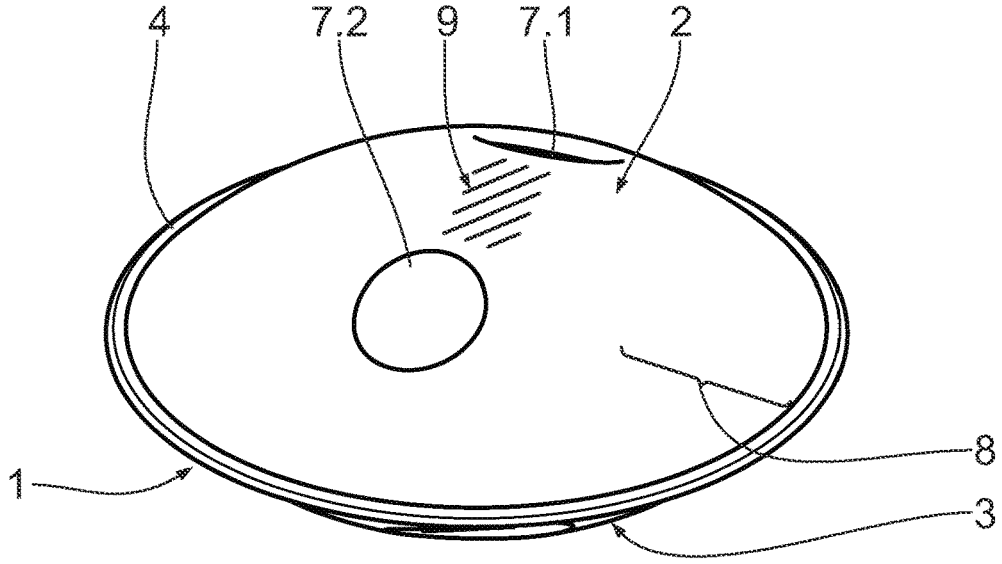

As can be seen in particular from FIGS. 1 and 2, a central basic tone field 5 is configured on the upper shell 3. Around this, eight further tone fields 6.1 to 6.8, which are tuned differently due to different diameters and shapes, are arranged annularly. This design of the upper shell 3 also applies to all further embodiments according to FIG. 7 to 10, so that no further description of the upper shell of these embodiments is necessary in this respect.

In the embodiment example of the handpan shown in FIG. 1 to 6, two resonance openings 7.1, 7.2 are introduced into the lower shell in a decentralized manner in the lateral, rising zone 8 of the lower shell 2, so that a zone 9 not occupied by the resonance openings 7.1, 7.2 is present centrally. The two resonance openings 7.1, 7.2 are arranged uniformly with respect to the circumferential direction U of the lower shell 2 due to their 180° offset opposition and have a matching diameter D7. The central zone 9 of the lower shell 2 not occupied by the resonance openings 7.1, 7.2 has a surface dimension F9 substantially corresponding to the diameter D7. The same applies to the distance A7 between the outwardly pointing edges 11 of the resonance openings 7.1, 7.2 and the outer edge 4 of the lower shell 2.

Figure 7:
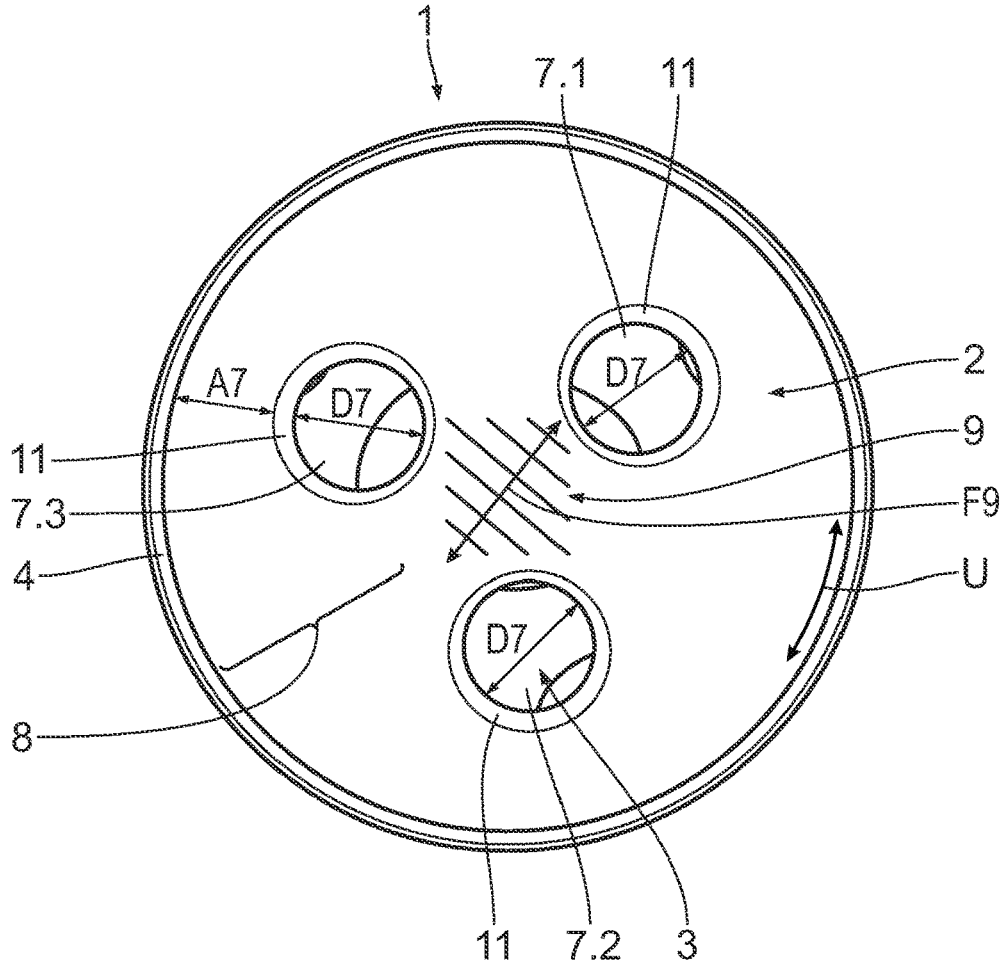
FIGS. 7 and 8 show a bottom view and perspective view, obliquely from below, of a handpan in a second embodiment.
Figure 8:
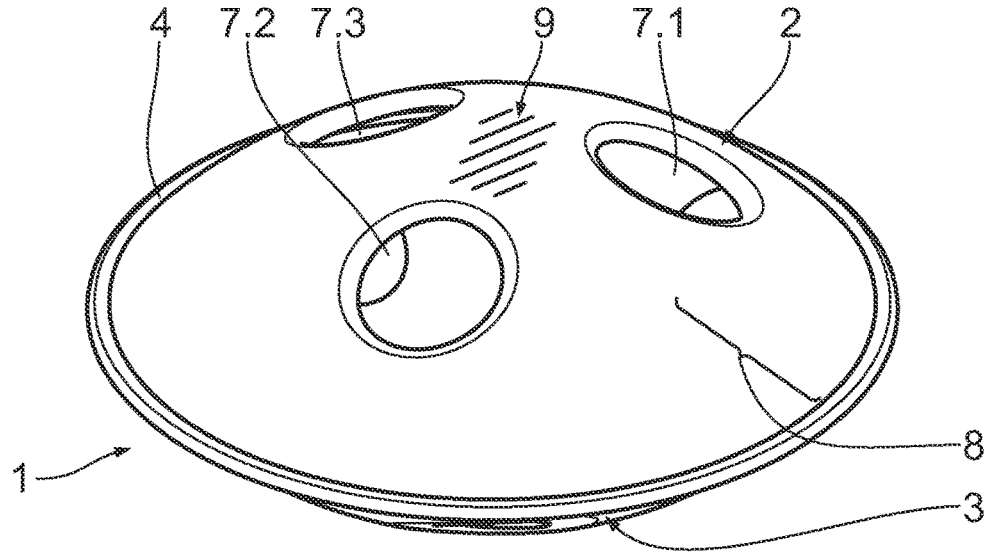
Figure 9:
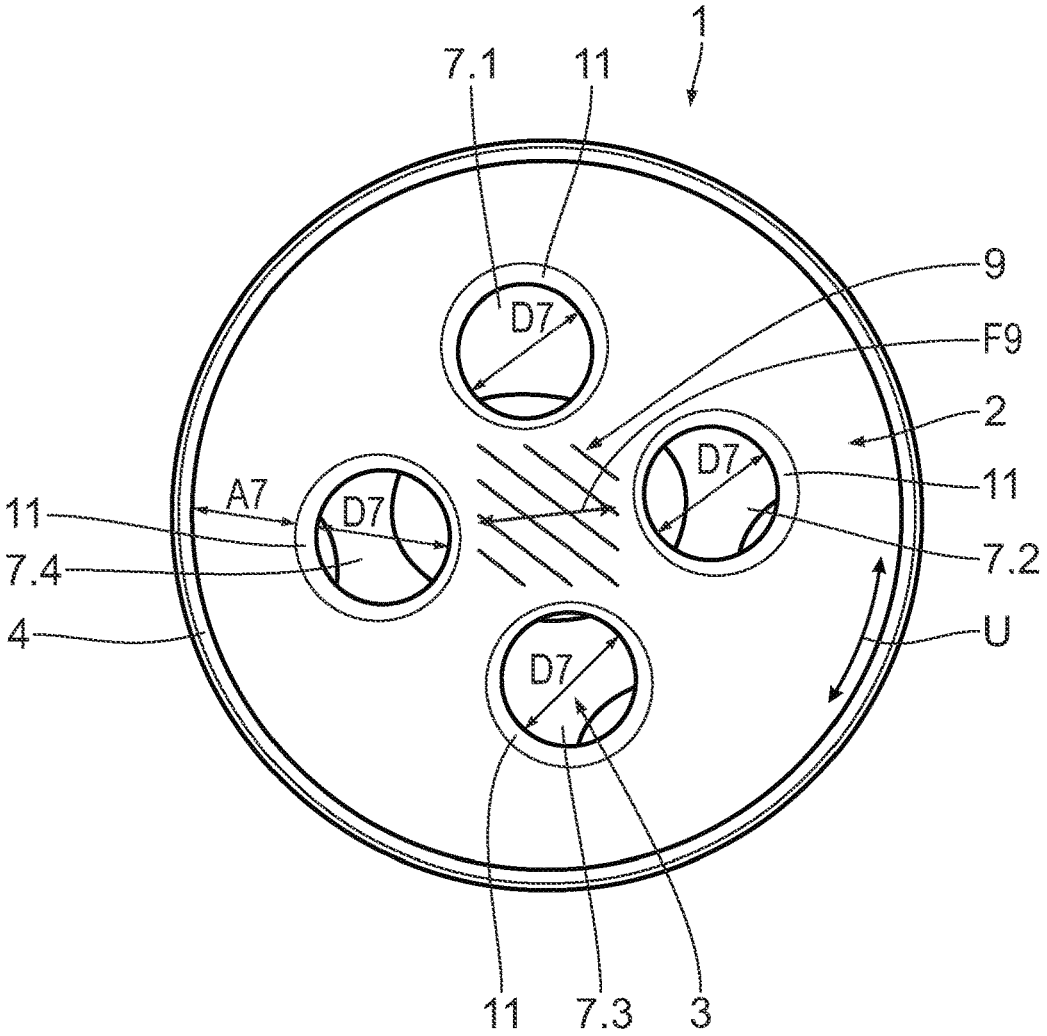
FIGS. 9 and 10 show a bottom view and perspective view, obliquely from below, of a handpan in a third embodiment.
Figure 10:
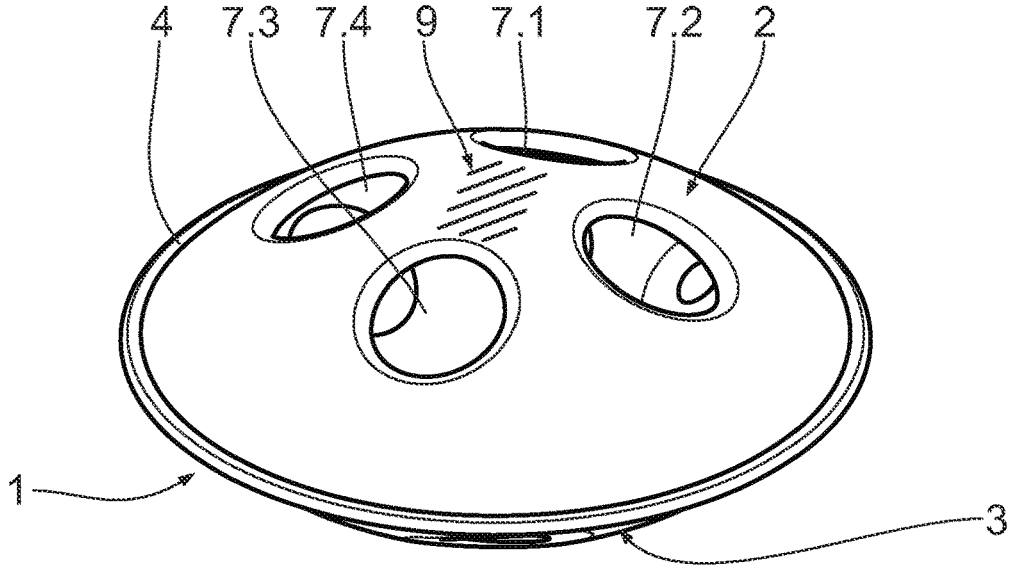

In contrast to the previous embodiment, the embodiment shown in FIGS. 7 and 8 has three resonance openings 7.1, 7.2, 7.3 in the lower shell 2, which in turn are arranged decentrally in the laterally rising zone 8 of the lower shell 2. As can be seen in particular from FIG. 7, the arrangement of the resonance openings 7.1, 7.2, 7.3 is here also uniform in the circumferential direction U, so that these openings are arranged offset from one another by an angle of 120° in the circumferential direction U with respect to one another. Surface dimension F9 and distance A7 analogously essentially correspond to the matching diameter D7 of the resonance openings 7.1, 7.2, 7.3.

Finally, in contrast to the previous embodiments, the embodiment shown in FIGS. 7 and 8 has four resonance openings 7.1, 7.2, 7.3, 7.4 in the lower shell 2, which are again arranged decentrally in the laterally rising zone 8 of the lower shell 2. As can be seen in particular from FIG. 9, the arrangement of the resonance openings 7.1, 7.2, 7.3, 7.4 is again uniform in the circumferential direction U, so that these openings are arranged offset from one another by an angle of 90° in the circumferential direction U with respect to one another. Surface dimension F9 and distance A7 analogously essentially correspond to the matching diameter D7 of the resonance openings 7.1, 7.2, 7.3, 7.4.

What is claimed is:

1. A handpan, comprising a hollow base body, composed of a lower shell and an upper shell, each in the form of a spherical segment, which are connected to one another at mutually facing outer edges thereof, a basic tone field, further tone fields arranged annularly on the upper shell, a resonance opening in the lower shell, and at least one further resonance opening in the lower shell, wherein the at least two resonance openings are arranged decentrally in the lateral rising zone of the lower shell.

2. The handpan according to claim 1, wherein the lower shell and the upper shell are glued to each other at their mutually facing outer edges.

3. The handpan according to claim 1, wherein the basic tone field is arranged centrally on the upper shell.

4. The handpan according to claim 1, wherein the further tone fields are arranged around the basic tone field.

5. The handpan according to claim 1, comprising one of the group comprising two, three and four resonance openings in the lower shell.

6. The handpan according to claim 1, wherein the resonance openings are arranged uniformly distributed with respect to a circumferential direction of the lower shell.

7. The handpan according to claim 1, wherein the resonance openings have a same diameter.

8. A handpan comprising:

a hollow base body, composed of a lower shell and an upper shell, each in the form of a spherical segment, which are connected to one another at mutually facing outer edges thereof, a basic tone field, further tone fields arranged annularly on the upper shell, a resonance opening in the lower shell, and at least one further resonance opening in the lower shell, wherein the at least two resonance openings are arranged decentrally in the lateral rising zone of the lower shell, wherein the resonance openings have a same diameter, and wherein a central zone of the lower shell not occupied by the resonance openings in a surface dimension substantially corresponds to the diameter of the resonance openings.

9. The handpan according to claim 7, wherein a distance between outwardly pointing edges of the resonance openings and the outer edge of the lower shell essentially corresponds to the diameter of the resonance openings.

10. The handpan according to claim 8, wherein the lower shell and the upper shell are glued to each other at their mutually facing outer edges.

11. The handpan according to claim 8, wherein the basic tone field is arranged centrally on the upper shell.

12. The handpan according to claim 8, wherein the further tone fields are arranged around the basic tone field.

13. The handpan according to claim 8, comprising one of the group comprising two, three and four resonance openings in the lower shell.

14. The handpan according to claim 8, wherein the resonance openings are arranged uniformly distributed with respect to the circumferential direction of the lower shell.

15. The handpan according to claim 8, wherein a distance between outwardly pointing edges of the resonance openings and the outer edge of the lower shell essentially corresponds to the diameter of the resonance openings.

* * * * *